US009284030B2

(12) United States Patent
Ganz

(10) Patent No.: US 9,284,030 B2
(45) Date of Patent: Mar. 15, 2016

(54) MAN OVERBOARD APPARATUS AND METHOD

(71) Applicant: Jonathan Ganz, Orangevale, CA (US)

(72) Inventor: Jonathan Ganz, Orangevale, CA (US)

( * ) Notice: Subject to any disclaimer, the term of this patent is extended or adjusted under 35 U.S.C. 154(b) by 55 days.

(21) Appl. No.: 14/065,185

(22) Filed: Oct. 28, 2013

(65) Prior Publication Data

US 2015/0118925 A1 Apr. 30, 2015

(51) Int. Cl.
*B63C 9/00* (2006.01)
*B63C 9/08* (2006.01)

(52) U.S. Cl.
CPC ..... *B63C 9/082* (2013.01); *B63C 9/081* (2013.01)

(58) Field of Classification Search
CPC ..... B63C 9/00; B63C 9/08; B63C 9/082; B63C 9/26; B63C 2009/08; B63C 2009/26
USPC ..... 441/80, 81, 84, 88, 106, 108, 113, 129, 441/131, 132, 133, 136
See application file for complete search history.

(56) References Cited

U.S. PATENT DOCUMENTS

| | | | | | |
|---|---|---|---|---|---|
| 3,121,240 | A | * | 2/1964 | Forbes | 441/94 |
| 3,696,453 | A | * | 10/1972 | Harris et al. | 441/80 |
| 3,754,291 | A | * | 8/1973 | Harris et al. | 441/80 |
| 4,033,276 | A | * | 7/1977 | Barr | 114/190 |
| 4,155,132 | A | * | 5/1979 | Lee | 441/80 |
| 4,228,556 | A | * | 10/1980 | Searls | 441/11 |
| 4,498,879 | A | * | 2/1985 | Burr | 441/80 |
| 4,560,356 | A | * | 12/1985 | Burr | 441/80 |
| 4,702,715 | A | * | 10/1987 | Winick | 441/80 |

* cited by examiner

*Primary Examiner* — Daniel V Venne

(57) ABSTRACT

The apparatus and method of the present invention provides for improving the reliability of the rescue of a man overboard, or MoB, whether or not that person is able to assist in their own rescue and whether or not the MoB is slightly submerged. The apparatus of the present invention is comprised of a foldable set of arms that, when deployed, are fixed at 90 degrees to each other forming an H-shaped geometry. The advantage of the H-shaped geometry is that it deploys both on, above and under the surface of the water, such that when the tether attached to the rescue device passes the MoB it readily becomes entangled. Advantageously, the apparatus of the present invention may be used with the majority of contemporary rescue devices.

9 Claims, 6 Drawing Sheets

MAN OVERBOARD APPARATUS AND METHOD

This non-provisional application for patent claims the earlier filing date of U.S. provisional application 61/721,642 under 35 USC 111(b).

BRIEF DESCRIPTION

The subject of this invention relates to open water vessels. The disclosed invention presents an apparatus and method for improving a man overboard rescue. Specifically, the disclosed invention improves both the recovery apparatus and the process for affecting a rescue, particularly where the man overboard is unconscious and unable to assist in his/her own rescue.

BACKGROUND OF THE INVENTION

Open water vessels have existed for centuries. For just as long men working the vessels have fallen overboard, necessitating the need for open water rescue. Historically the survival rate was very low due to the nature of the craft, the speed with which they could respond, the lack of ability to survive adverse conditions, the techniques available to the rescuers.

Modernly, the speed of the vessels involved, the maneuverability, the rescue techniques and related rescue equipment have improved greatly. Even modern sailing craft are able to return to the area where the person went overboard in a reasonably short time, due in great part to auxiliary power. However, it must be noted that stopping a vessel of any type next to a person who has fallen overboard, regardless of whether or not they are conscious, is very difficult in adverse conditions such as high winds, high waves and/or strong currents.

Also to be considered, the equipment and methods in use today are far superior to those employed in the past. Regulatory agencies such as the U.S. Coast Guard set safety requirements and have the power to monitor all craft, levying fines and/or restricting operation when required. The combination of these changes and efforts have improved the survivability of a person who inadvertently falls overboard.

Contemporarily, several methods for recovering a person who has fallen overboard, referred to as 'man overboard', or MoB, are known and in use. These run the gamut from throwing a simple life ring or life jacket to complex harness-and-sling equipment. Each of these devices has had some success, but each has a number of serious drawbacks. By way of example, a life ring requires that the man overboard be conscious and capable of assisting his/her own rescue by grasping the device. And while rare, throwing a life ring at a man overboard may cause injury if the device strikes the individual on the head.

Sling and/or harness devices require skill to use, usually requiring third party assistance, for example helicopter crews, and can require significant training to be effective. As with the simple life ring method, if the individual is unconscious these devices are even less useful. And unlike the simple ring or horseshoe devices, the sling/harness devices are expensive.

Each of the contemporary devices may also be used with a series of vessel maneuvers that allow the retrieval of the man overboard. The most successful maneuver can be described as a buttonhook because the vessel turns immediately after deploying the retrieval device, moves away from the MoB far enough to allow the device tether to deploy. Once deployed, the vessel then performs another tight turn, passing between the Mob and the device to ensure that the tether does not foul in the vessel's prop or hull. Once past the Mob, the vessel turns a third time, causing the tether to drag in close proximity to the Mob.

While this method works well enough for a conscious MoB, it fails regularly for an unconscious MoB. This is because the unconscious MoB is not able to react to the presence of the tether, rendering him/her unable to grasp the rescue device. Moreover, if the MoB is slightly submerged, due for example to heavy clothing, the tether will simply pass over the intended rescue target requiring, at a minimum, a second, time consuming set of maneuvers. What would be desirable would be an apparatus and method that would allow an MoB to be recovered reliably whether or not the MoB is able to assist in his/her own rescue and whether or not the MoB is slightly submerged.

SUMMARY OF THE INVENTION

The apparatus and method of the present invention provides for improving the reliability of the rescue of a man overboard, or MoB, whether or not that person is able to assist in their own rescue and whether or not the MoB is slightly submerged. The apparatus of the present invention is comprised of a foldable set of arms that, when deployed, are fixed at 90 degrees to each other forming an H-shaped geometry. The advantage of the H-shaped geometry is that it deploys both on, above and under the surface of the water, such that when the tether attached to the rescue device passes the MoB it readily becomes entangled. Advantageously, the apparatus of the present invention may be used with the majority of contemporary rescue devices.

The apparatus of the present invention is comprised of three spring loaded rectangular solids. The primary rectangular foam solid deploys in a horizontal orientation with respect to the surface of the water while two secondary rectangular foam solids, one attached to each end of the primary rectangular foam solid, deploy vertically with respect to the surface of the water to form the H-shaped geometry. Each of the rectangular foam solids has a flat stainless steel spring embedded in it, such that the spring straightens out when no external compressing force is acting upon it.

The primary rectangular foam solid attaches to any one of a number of contemporary rescue devices, for example a life ring or a LifeSling® [Owen Mills, Inc., Van Nuys, Calif.] by means of a latch mechanism. Once attached, the rescue device and the apparatus of the present invention are placed into a soft cover such that a compression force is applied to the rectangular foam solids. This compression force causes the embedded springs inside the rectangular volumes to distort, or load up, storing the necessary potential energy for deployment.

Further, the two secondary rectangular foam solids have a pair of inserts that serve to compress the embedded spring further, effectively locking them in the closed state. The reason for this is to ensure that the secondary rectangular foam solids do not inadvertently deploy. Each of the pairs of inserts has a short cord attached to it such that when the apparatus is deployed, the inserts are pulled out allowing the secondary rectangular foam solids to expand under the influence of the embedded springs.

In operation, when a MoB situation arises, the apparatus of the present invention is immediately deployed. At this point the primary rectangular foam solid expands under the influence of the embedded spring adopting a horizontal orientation with respect to the surface of the water. As the primary rectangular foam solid expands it applies a pulling force to the short cords attached to the inserts of the two secondary rectangular foam solids, pulling the inserts outward, allowing the secondary rectangular foam solids to assume the vertical orientation with respect to the surface of the water. Once all three rectangular foam solids have expanded into their fully deployed state the H-shaped geometry is achieved.

As is the case with current methods, the tether attached to the device trails for a short period of time. When the tether becomes taught, the vessel performs the buttonhook maneuver to allow the MoB to grasp the rescue device if he/she is able. If not, for example if the MoB is unconscious, the H-shaped geometry of the apparatus of the present invention captures the MoB due to the fact that elements of the apparatus are on the surface as well as above and below the surface. The fact that a portion of the present apparatus lies below the surface of the water allows an increased chance of a successful rescue of a MoB who is partially submerged, as would be the case for a person dressed in heavy clothing or foul weather gear.

The present invention is discussed in detail below in conjunction with the drawings listed below. As will be evident, the apparatus and method of the present invention overcomes the disadvantages of the prior art.

DETAILED DESCRIPTION OF PREFERRED EMBODIMENTS

For the detailed description that follows the term "man overboard" is used, and is at times abbreviated to MoB. While current texts in this area of art refer to "crew overboard", the historical term will be used since it is still in common use. The term "man overboard" will be understood to include any person who has accidentally fallen overboard. Additionally, the present invention may be used with a variety of currently available rescue devices that are referred to as contemporary rescue devices. Where appropriate, specific examples of such devices are given.

Figure 1:
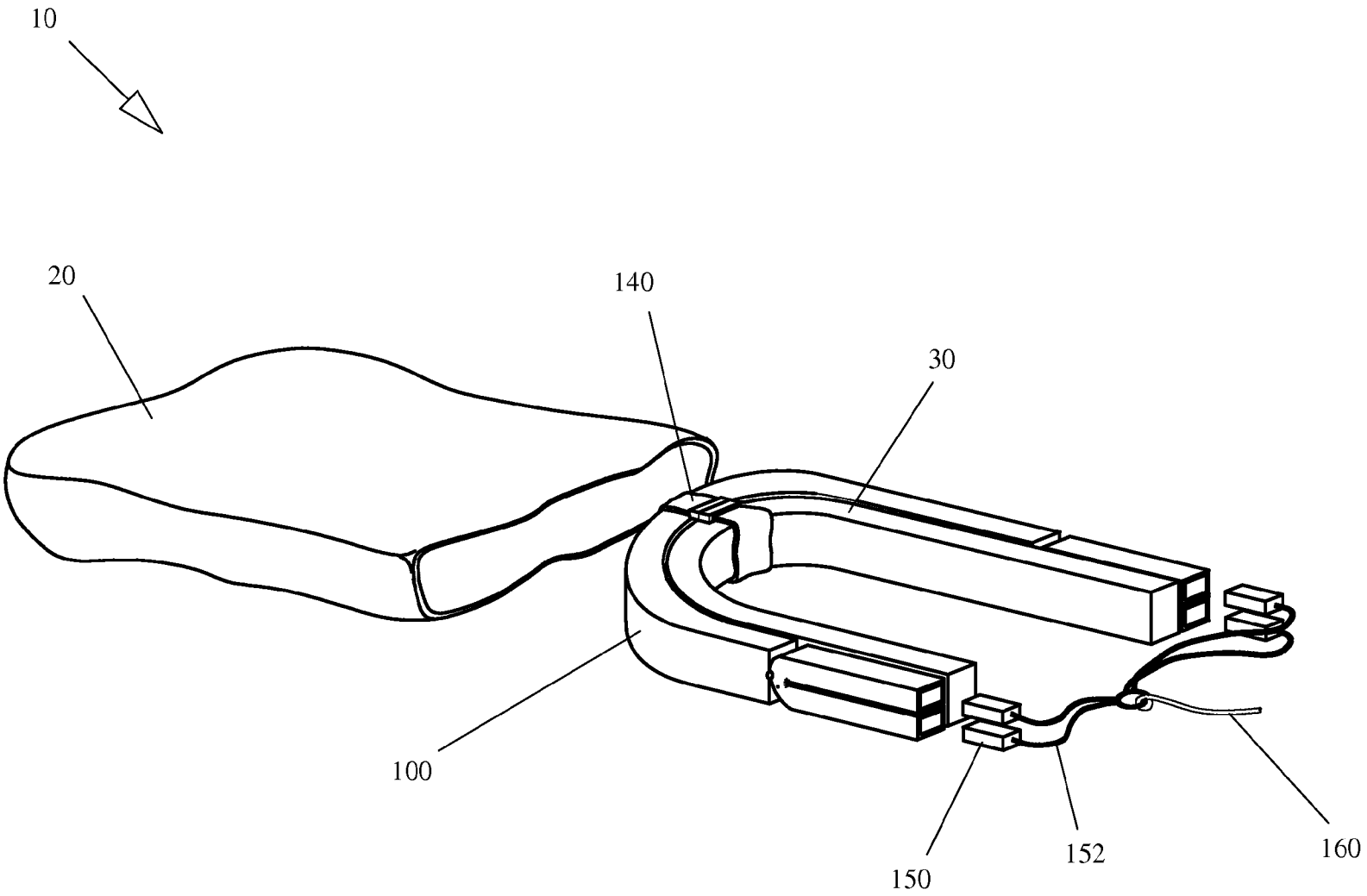
FIG. 1: is an overall view of the apparatus of the present invention.

As described briefly above, the apparatus of the present invention may be used with a variety of contemporary rescue devices or as a stand-alone rescue device. FIG. 1 shows an overall view of the apparatus of the present invention 10. In this embodiment the apparatus of the invention 100 is attached to a contemporary horseshoe rescue device 30, for example, the Cal-June Horseshoe Buoy from Cal-June, Inc., North Hollywood, Calif., via strap 140. As discussed in detail below, key to the operation of the apparatus of the present invention are keeper blocks 150. Note that in FIG. 1 only one such keeper block 150 is shown for clarity, but there are four such keeper blocks in total.

Each of the separate keeper blocks 150 is attached to a tether 160 by means of a short cord 152. As with keeper blocks 150, only one short cord 152 is shown but it will be understood by those of skill in the art that a similar short cord exists for all keeper blocks. In a preferred embodiment, keeper blocks 150 are made from plastic, but as will be recognized by those of skill in the art, the keeper blocks 150 could be made from other materials, including wood or aluminum, thus the use of plastic is not meant as a limitation on scope of the invention.

Because the apparatus of the present invention is constructed of a set of rectangular foam solids, the apparatus 100 is flexible, thus may be manipulated to conform to the shape of the host rescue device. This is important to note since the apparatus of the present invention could conceivably be attached to a ring buoy or rectangular cushion flotation device as well as to a horseshoe device as is shown. It will be recognized by those of skill in the art that the use of a horseshoe device is not meant as a limitation on the scope of the invention.

With keeper blocks 150 inserted into receiver slots in a pair of secondary rectangular foam volumes, and the strap 140 in place, the combined apparatus 100 and host rescue device 30 are placed into a carrier bag 20. Note that the act of conforming the apparatus 100 about the host rescue device 30 provides a compression force as detailed below, thus the apparatus 100 fits snugly into the carrier bag 20. As used in this specification, snugly is defined as a loose clearance fit [ANSI LC or equivalent] wherein the apparatus 100 may be freely placed in the carrier bag 20 without difficulty. As is normal for contemporary rescue devices, the carrier bag 20 may be mounted on a rail, stored in a locker or kept in some other convenient place ready for use.

Figure 2:
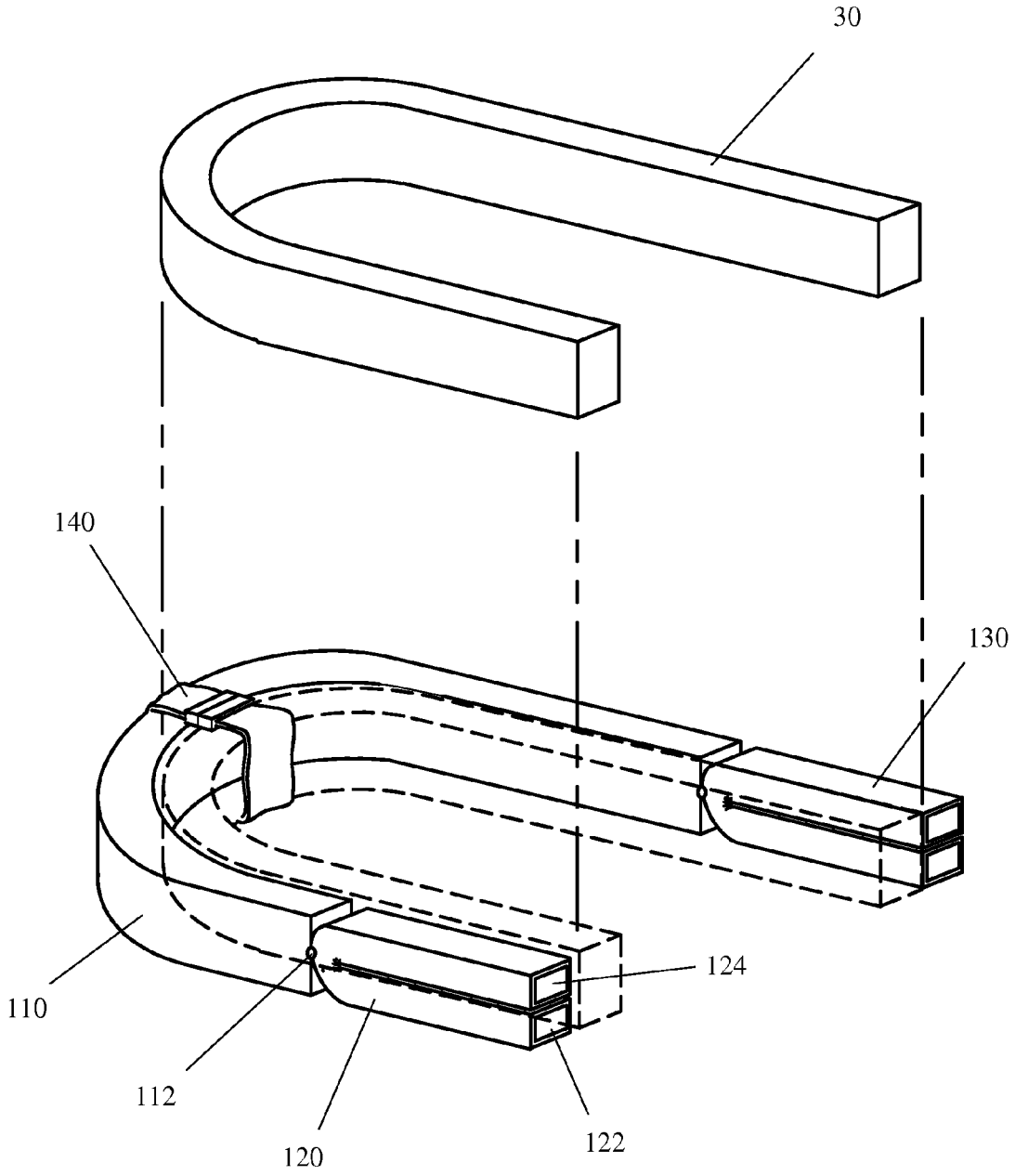
FIG. 2: shows the apparatus of the present invention as it is attached to a contemporary rescue device.

FIG. 2 provides a more detailed view of how the apparatus of the present invention is integrated with a contemporary rescue device 30. The apparatus of the present invention is comprised of three spring loaded rectangular foam solids 110, 120 and 130. Each of the three spring loaded rectangular foam solids 110, 120 and 130 is constructed of a porous foam material that has been molded about a linear stainless steel spring [discussed below in conjunction with FIG. 3] such that each of the three spring loaded rectangular foam solids 110, 120 and 130 is free to bend in only one direction. Note that other spring materials could be used without departing from the spirit of the invention, thus the use of stainless steel is not meant as a limitation.

The primary rectangular foam solid 110 has its embedded primary spring oriented such that in the absence of a compressing force it achieves a static state along a horizontal axis [H-H of FIG. 3]. Since the primary rectangular foam solid 110 is flexible, a bending force applied to its extreme ends allows it to be conformed to the outer surface of a rescue device [30 in FIG. 1]. When this is done the primary spring becomes compressed and, as stated above, in the absence of that compressing force the primary spring forces the primary rectangular solid out of its conformed state. Primary rectangular foam solid 110 is prevented from shifting with respect to the rescue device 30 by means of a strap 140. Strap 140 is placed about rescue device 30 and closed using any of a plurality of strap closure means including hook-and-loop [for example Velcro® from 3M Corporation, Minneapolis, Minn.], or snap-and-latch [for example a P006 side latch buckle from Best Buy Button & Buckle LLC, Pasadena, Calif.]. It will be recognized by those of skill in the art that the precise closure means of strap 140 does not impinge on the implementation of the invention, thus the scope of the invention is limited only by the claims. It will be further recognized that the strap material may vary without departing from the spirit of the invention, but in this exemplary implementation, the strap 140 is made from a flat woven nylon and the strap closure means is of the snap-and-latch variety.

Secondary spring loaded rectangular foam solids 120 and 130 are attached to the primary rectangular foam solid 110 by a hinge means 112, one at each extreme end of primary rectangular foam solid 110. Note that the following discussion describes secondary rectangular foam solid 120, but that the discussion applies to secondary rectangular foam solid 130 as well. The secondary rectangular foam solid 120 has an embedded secondary spring such that when no compression force is applied, it orients itself along the vertical axis. For the secondary spring, compression force is supplied by folding the secondary foam solid 120 back on itself such that the two extreme ends of the secondary foam solid 120 meet each other. Because it is permanently attached to the extreme end of primary rectangular foam solid 110 by hinge means 112, secondary rectangular foam solid 120 achieves a perpendicular orientation with respect to primary rectangular foam solid 110 in the absence of a compressing force. In the embodiment shown in FIG. 2 the hinge means 112 uses a sewn fabric flap, but it will be understood that other hinge means could be used without departing from the spirit of the invention, for example, a plastic hinge.

Under a compression force applied to its extreme ends, secondary rectangular foam solid 120 becomes an extension of primary rectangular foam solid 110. A pair of receiver slots 122 and 124 are dimensioned to accept a pair of keeper blocks [150 of FIG. 1] such that when the keeper blocks are in place, the embedded secondary spring in secondary rectangular foam solid 120 becomes loaded, but is unable to expand due to the interference of the keeper blocks in receiver slots 122 and 124. While the precise dimensions of the fit between the receiver slots 122 and 124 and the keeper block 150 are not critical, the dimensions do require an ANSI RC-7 loose running fit as set forth by the American National Standards Institute. In a similar manner, secondary rectangular foam solid 130 becomes an extension of the primary foam volume 110.

To complete the integration of the apparatus of the present invention with the rescue device 30, the rectangular foam solids 110, 120 and 130 are conformed about the rescue device 30 and inserted into a carrier bag 20 as discussed in FIG. 1 just above. The act of inserting the apparatus of the present invention into the carrier bag 20 provides the compressing force required to conform the rectangular foam solid 110, about the rescue device 30, thereby loading the primary spring embedded in the primary rectangular foam solid 110. The secondary foam solids 120 and 130 have the requisite compression force applied by inserting the keeper blocks [150 of FIG. 1] into the receiver slots 122 and 124 as discussed above. In the embodiment presented the carrier bag is made from nylon, but it will be recognized that other materials, for example canvass, could be used without departing from the spirit of the invention.

Figure 3A:
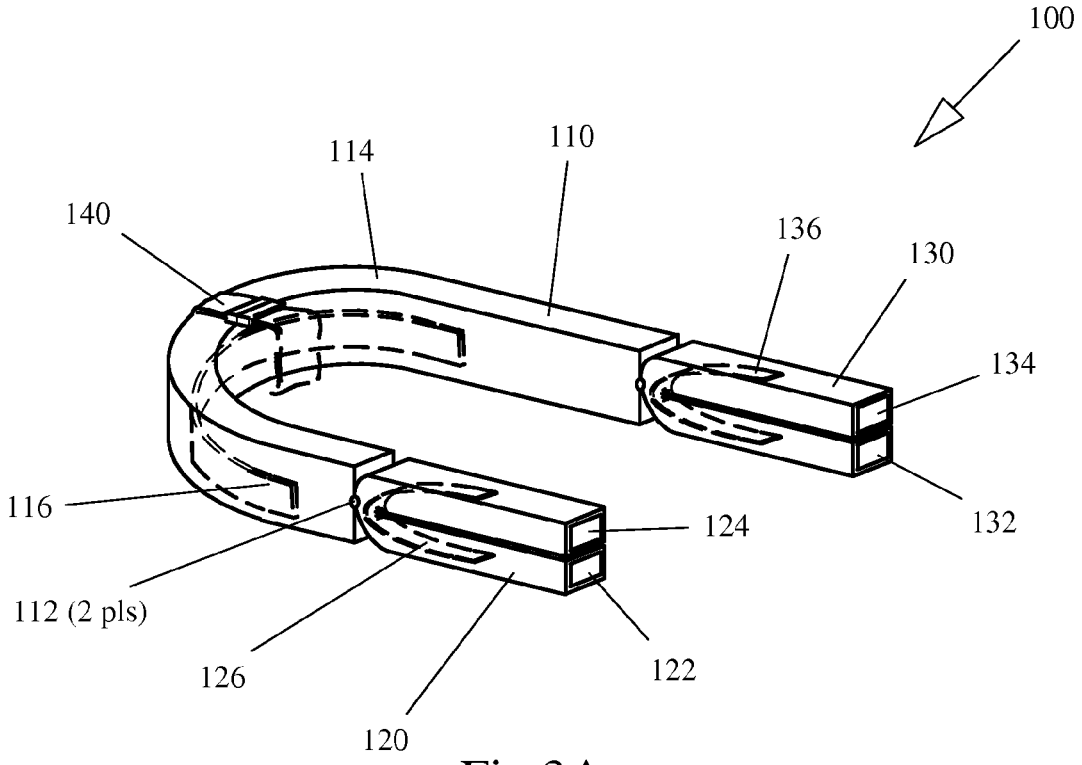
FIG. 3A: provides a view of the pre-deployment condition of the apparatus of the present invention.

Looking now at FIG. 3, the operational details for the apparatus of the present invention 100 are shown. Note that for the discussion of FIG. 3 the rescue device [30 of FIG. 2] is not shown for clarity, however it is assumed that the device is present. Beginning with FIG. 3A, the apparatus 100 is shown in what would be the pre-deployment condition. That is, primary rectangular foam solid 110 of apparatus 100 is conformed to the outer surface of the rescue device and in its carrier bag [also not shown for clarity], held in place at its center by strap 140. Primary rectangular foam solid 110 is constructed from porous foam 114 that has been molded about linear stainless steel primary spring 116. In the embodiment presented the porous foam is polyurethane but use of this material is not meant as a limitation on the scope of the invention. Other floatation foams may be used, for example, fiberglass, without departing from the spirit of the invention. In this state, the primary spring 116 has been loaded due to a compression force applied by conforming the primary rectangular foam solid 110 about the rescue device.

Secondary rectangular foam solids 120 and 130 are constructed of the same material as the primary rectangular foam solid 110 but are dimensioned so that when folded into the compressed state as shown in FIG. 3A they form an extension to the primary rectangular foam solid 110. The precise dimensions of the primary and secondary rectangular solids 110, 120 and 130 are not critical except to the extent that when in the folded state as shown the height and width of the secondary foam solids 120 and 130 are the same as the height and width of the primary foam solid 110.

As with the primary rectangular foam solid 110, secondary rectangular foam solid 120 has been molded about linear stainless steel first secondary spring 126 and is attached to a first extreme end of primary rectangular foam solid 110 by hinge means 112. In this orientation a compression force has been applied at the extreme ends of secondary rectangular foam solid 120 placing a load on the first secondary spring 126. The secondary rectangular foam solid 120 is held in this orientation prior to deployment by keeper blocks [150 of FIG. 1] inserted into receiver slots 122 and 124.

Secondary rectangular foam solid 130 is constructed of the same material as primary foam solid 110 but dimensioned so that when compressed as shown in FIG. 3A it forms an extension to the primary rectangular foam solid 110 and is attached to a second extreme end of primary rectangular foam solid 110 by hinge means 112. As with the primary rectangular foam solid 110, secondary rectangular foam solid 130 has been molded about linear stainless steel second secondary spring 136. In this orientation a compression force has been applied at the extreme ends of secondary rectangular foam solid 130 placing a load on second secondary spring 136. The secondary rectangular foam solid 130 is held in this orientation prior to deployment by keeper blocks [150 of FIG. 1] inserted into receiver slots 132 and 134.

Figure 3B:
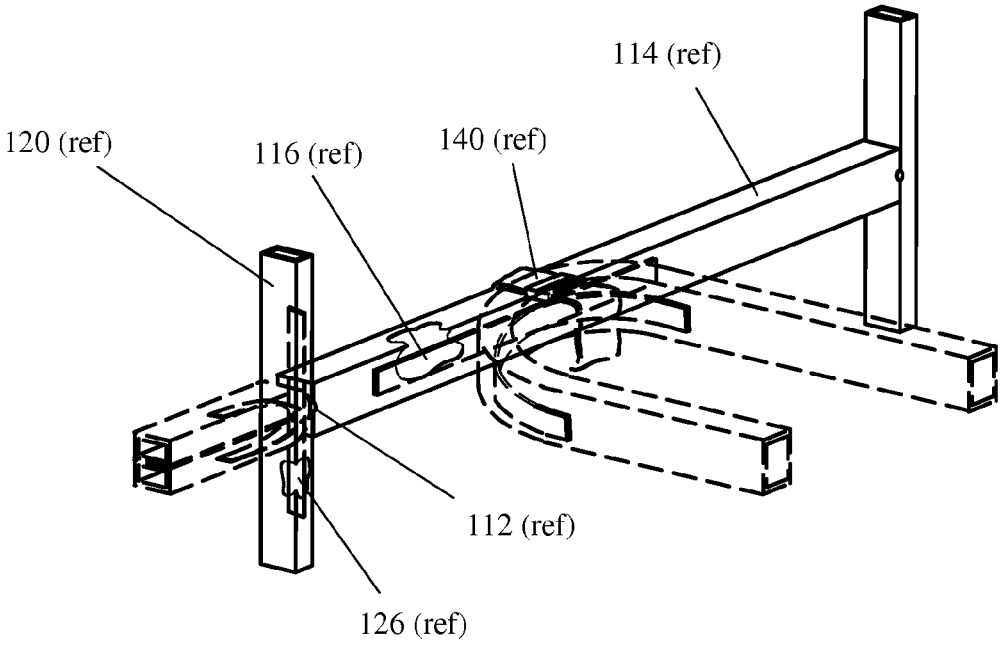
FIG. 3B: provides a view of the post-deployment condition of the apparatus of the present invention.

Turning now to FIG. 3B, the apparatus 100 is shown in the deployed state. In this state the apparatus of the present invention has attained an H-shaped shaped geometry. This occurs because the primary rectangular foam solid 110 has reacted to the expansion of primary spring 116 and since the porous foam material 114 is flexible, primary rectangular foam solid 110 has settled into a horizontal orientation as shown by H-H. Because strap 140 holds the primary rectangular foam solid 110 in place at its center, the rescue device [30 of FIG. 2] and the primary rectangular foam solid 110 are both lying in a horizontal plane parallel to and on the surface of the water.

At the same time as the primary rectangular foam solid 110 reacts to primary spring 116, secondary rectangular foam solids 120 and 130 react to their internal secondary springs 126 and 136 respectively. Since the secondary rectangular foam solids 120 and 130 are attached to the opposed extreme ends of the primary rectangular foam solid 110 by hinge means 112, they assume a vertical orientation V-V with respect to the primary rectangular foam solid 110. In so doing, an H-shaped geometry is obtained with the secondary rectangular foam solids 120 and 130 protruding above the water surface and extending below the water surface. This is an important characteristic of the present invention since it provides for the case where the MoB to be rescued may be partially submerged due to heavy clothing, for example, boots, or foul weather gear.

At this point in time the improved apparatus 100 has occupied two perpendicular planes in addition to the horizontal plane normally occupied by a floating rescue device providing a substantially increased likelihood that a tether attached to a rescue device will become entangled with the rectangular foam solids of the present invention whether or not the MoB to be rescued is conscious or not. In the embodiment shown, the primary rectangular foam solid is approximately thirty inches long by three inches wide by five inches high. The secondary rectangular foam solids are approximately twelve inches long by three inches wide by two and a half inches high. Of course other dimensions for the rectangular foam solids are possible without departing from the spirit of the invention thus the dimensions given are not meant as a limitation on the scope of the invention. Note that secondary rectangular foam solid 130 reacts in an identical manner to secondary rectangular solid 120, thus is not discussed to aid in clarity.

Figure 4:
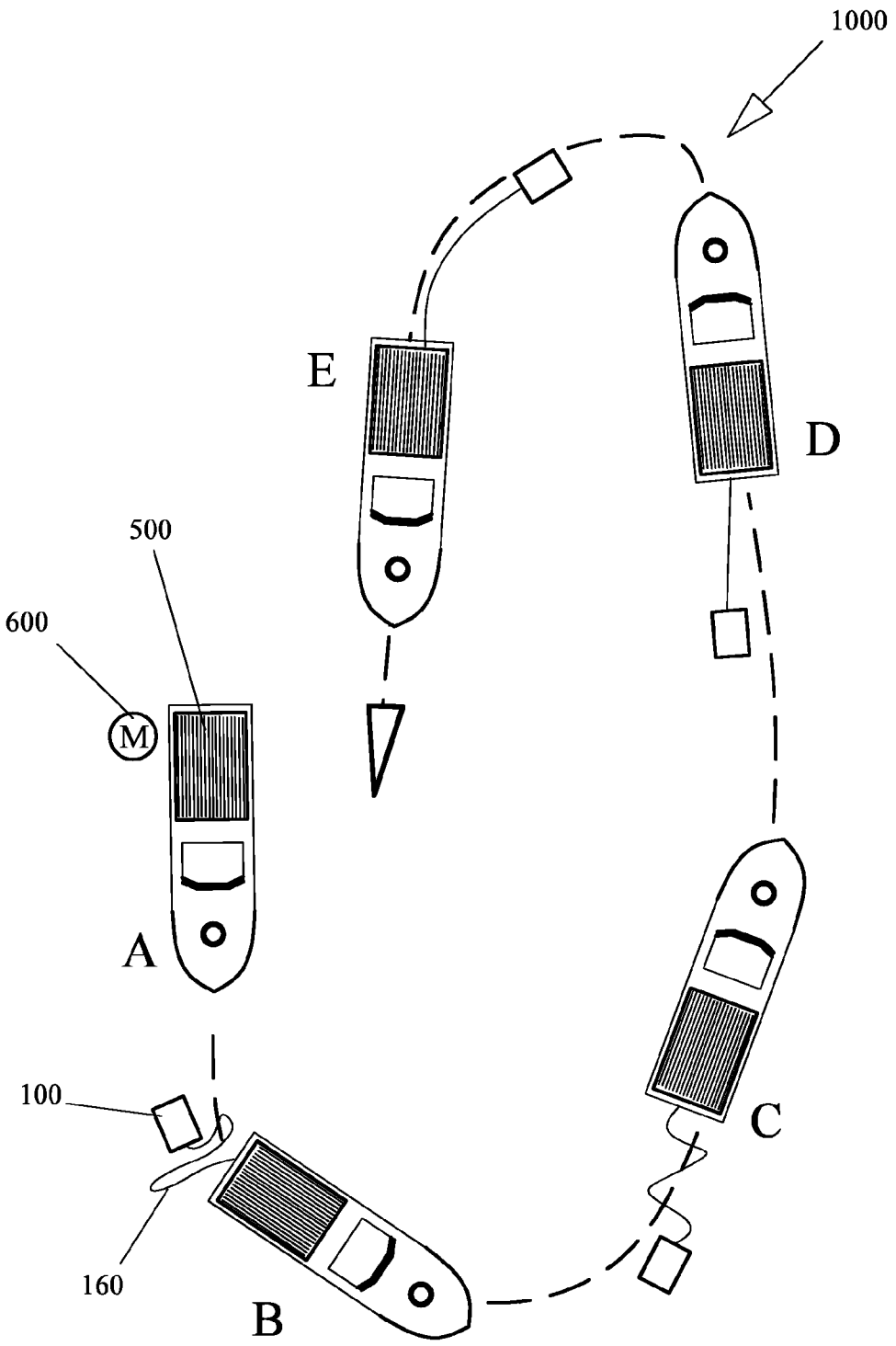
FIG. 4: shows the deployment phase of the rescue method of the present invention.
Figure 5:
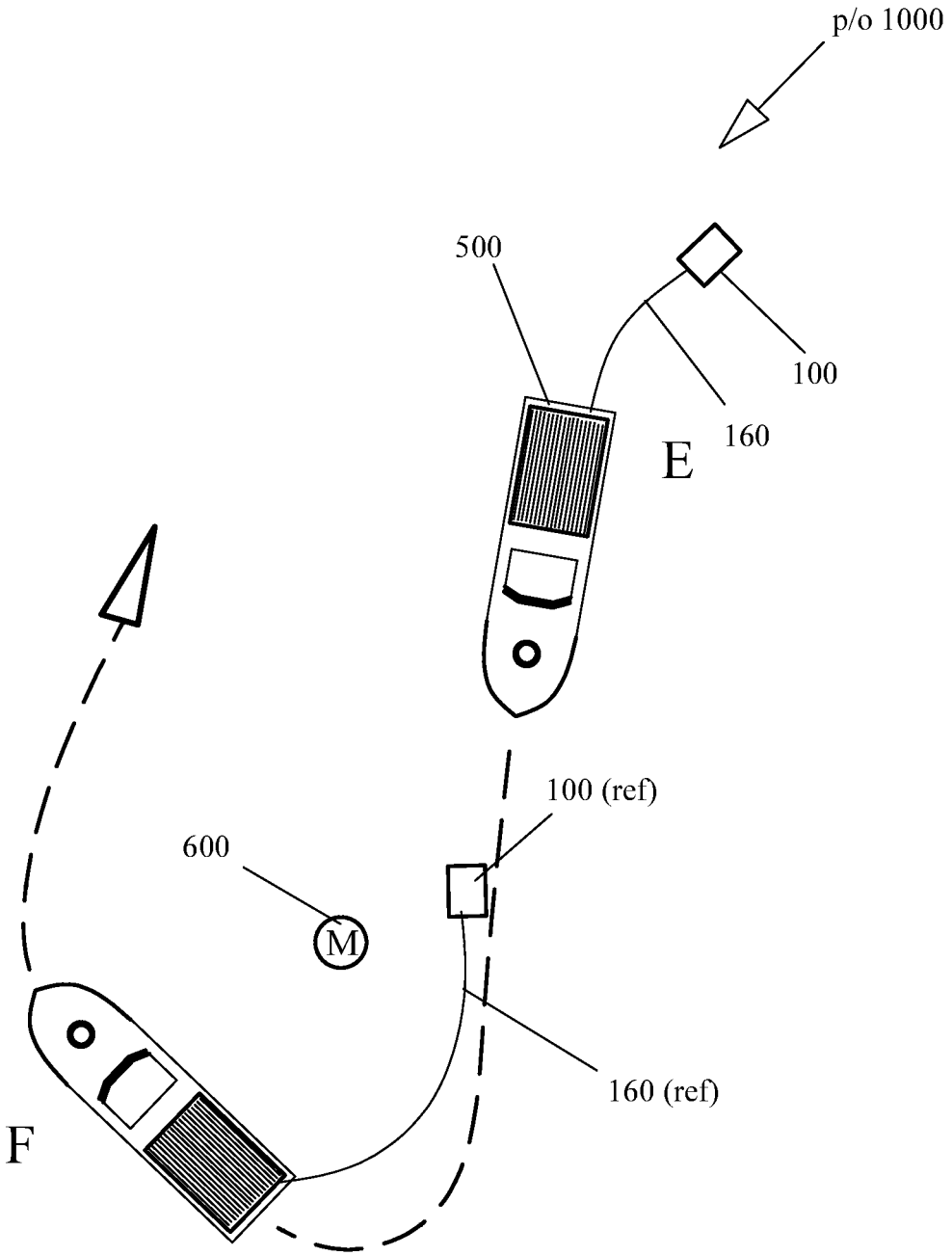
FIG. 5: shows the approach phase of the rescue method of the present invention.
Figure 6:
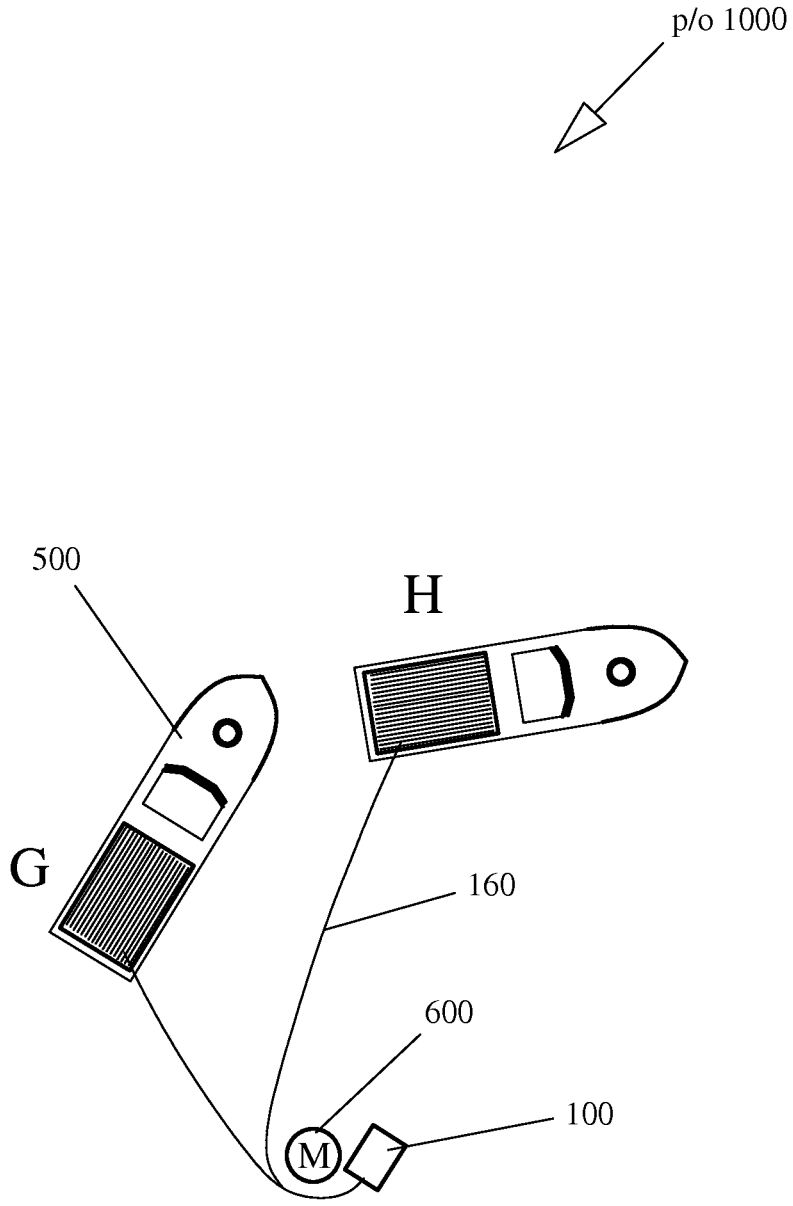
FIG. 6: shows the capture phase of the rescue method of the present invention.

The method 1000 for using the apparatus of the present invention is discussed in FIGS. 4 through 6. Note that while for the discussion that follows a motor powered vessel is shown, the same method may employed for a sail powered vessel, the primary difference being the need for the sailing vessel to manipulate its sails in order to accomplish the maneuvers presented. Beginning with FIG. 4, and supposing vessel 500 has a man overboard [MoB] event as shown by M 600 at position A, the vessel operator immediately executes a sharp turn in a direction that allows the MoB M 600 to remain in view, as shown at position B.

While at position B, and while continuing the sharp turn the crew of the vessel 500 deploys the apparatus 100 of the present invention by removing it from its carrier bag causing primary spring [116 of FIG. 3] to obtain a static state which then causes the keeper blocks [150 of FIG. 1] to be pulled from their receiver slots [122, 124, 132 and 134 of FIG. 3]. Since the keeper blocks have been removed from their receiver slots the secondary springs [126 and 136 of FIG. 3] obtain their static state which is at a 90 degree angle to the primary rectangular solid. At this time the primary and secondary rectangular solids have formed the H-shaped geometry of the present invention. Since the primary rectangular solid is attached to the contemporary rescue device at its center, when the apparatus of the present invention hits the water surface the contemporary rescue device and the primary rectangular volume occupy a horizontal plane with respect to the water surface while the two secondary rectangular solids occupy a vertical plane with respect to the water surface.

After hitting the water surface the tether 160 begins to extend. Recall from above that the act of deploying the apparatus 100 results in the formation of the H-shaped geometry meaning that once the rescue device with the apparatus 100 attached hits the surface of the water, a portion of the apparatus 100 is above the surface, a portion on the surface and a portion below the surface. As the vessel 500 continues its turn as shown at position C the apparatus 100 continues to extend until the tether 160 reaches its full length such as at position D. Vessel 500 continues the turning maneuver causing the apparatus 100 and associated tether 160 to form an arc.

Continuing with FIG. 5, the vessel 500 is now at position E, with the apparatus 100 and tether 160 forming an arc behind vessel 500. The vessel 500 maneuvers toward the MoB 600, being certain that the apparatus 100 and the tether 160 do not foul in the vessels running gear. Once past the MoB 600 the vessel makes a second sharp turn, referred to as a buttonhook maneuver, again keeping the MoB 600 in view, as at position F. For a detailed discussion of the buttonhook maneuver see http://www.sailnow.com/mobile/cob.html.

Finally, as shown in FIG. 6, the vessel 500 now at position G continues toward position H, causing the apparatus 100 to come in contact with to the MoB 600. At this point the vessel 500 ceases its forward motion and the crew begins hauling on tether 160. Because the apparatus 100 of the present invention has elements above, at the surface and below the surface of the water, the tether 160 is able to acquire the MoB 600 even if the person is not conscious or is partially submerged. Again due to the H-shaped geometry of the apparatus 100, the crew aboard vessel 500 is able to haul the MoB 600 close enough to the vessel 500 to complete the rescue.

One advantage of the present invention is that it is economical. This is true since the apparatus of the present invention can be used with a variety of existing rescue devices. Thus both current owners of boats and manufacturers of rescue devices are able to take advantage of the invention.

A second advantage of the present invention is the ability to improve the outcome of a rescue operation when the person to be rescued is not conscious. This is so because the apparatus of the invention deploys to an H-shaped geometry, having elements above, on and below the surface of the water providing a significantly increased chance of ensuring a successful rescue.

A third advantage of the present invention is the ability to improve the outcome of a rescue operation when the person to be rescued is partially submerged as may happen when the person overboard has heavy clothing or foul weather gear on. This is so because the apparatus of the invention deploys to an H-shaped geometry, having elements above, on and below the surface of the water providing a significantly increased chance of ensuring a successful rescue.

A fourth advantage of the present invention is that it may be used with virtually any type of boat. Whether the vessel is a power or sail type craft, or whether it is large or small, the apparatus and method of the present invention allows its use without restriction.

A fifth advantage of the present invention is that it may be used as a stand-alone device. While the present invention is designed in such a way as to allow use with contemporary rescue devices, the apparatus may be packed in a carrier bag without such a device.

What is claimed is:

1. A man overboard rescue apparatus comprising:

a primary rectangular solid, said primary rectangular solid having internally contained a primary spring, a compressing force having had been applied to said primary spring where, in the absence of said compressing force said primary spring attains a static horizontal orientation when said primary rectangular solid is floating on the water surface;

a first secondary rectangular solid, said first secondary rectangular solid having internally contained a first secondary spring, a compressing force having had been applied to said first secondary spring where, in the absence of said compressing force said first secondary spring attains a static perpendicular orientation when said first secondary rectangular solid is floating on said water surface, said first secondary rectangular solid being hingeably attached at the center of said first secondary rectangular solid to a first extreme end of said primary rectangular solid, said first secondary rectangular solid having a cavity at each end to receive a keeper block;

a second secondary rectangular solid, said second secondary rectangular solid having internally contained a second secondary spring, a compressing force having had been applied to said second secondary spring where, in the absence of said compressing force said second secondary spring attains a static perpendicular orientation when said second secondary rectangular solid is floating on said water surface, said second secondary rectangular solid being hingeably attached at the center of said second secondary rectangular solid to a second extreme end of said primary rectangular solid, said second secondary rectangular solid having a cavity at each end to receive a keeper block;

a set of four cords, each of said four cords having a said keeper block attached at a first end and a second end of said four cords attached to a first end of a tether, and the second end of said tether cord being free for use in hauling said rescue apparatus toward a rescue vessel;

a strap, said strap used to fixably attach said primary rectangular solid at the center of said primary rectangular volume to a contemporary rescue device;

a carrier bag dimensioned such that said primary rectangular solid, said first secondary rectangular solid and said second secondary rectangular solid when conformed to said contemporary rescue device fits into said carrier bag, such that said carrier bag a maintains a compressing force on said primary rectangular solid and said keeper blocks maintain a compressing force on said first secondary rectangular solid and said second secondary rectangular solid such that when said primary rectangular solid is removed from said carrier bag said compressing force on said primary rectangular solid is released causing said primary spring to obtain a static state such that said primary rectangular solid is oriented horizontally to said water surface and wherein obtaining said static state of said primary spring causes said keeper blocks to be retracted from said receiver slots by said four cords such that said compressing force on said first secondary solid and said second secondary solid is released causing said first secondary spring and said second secondary spring to obtain a static state such that said first secondary solid and said second secondary solid are oriented perpendicularly to said water surface wherein each of said first secondary solid and said second secondary solid are partially above said water surface and partially below said water surface thereby forming an H-shaped configuration.

2. The primary rectangular solid, first secondary rectangular solid and second secondary rectangular solid of claim 1 wherein each of said rectangular solids is made from polyurethane foam.

3. The primary spring, first secondary spring and second secondary spring of claim 1 wherein each of said springs is made from stainless steel.

4. The keeper blocks of claim 1 wherein each of said keeper blocks are made from plastic.

5. The strap of claim 1 wherein the strap is made from nylon.

6. The strap of claim 1 wherein the closure means is side latch buckle.

7. The rescue apparatus of claim 1 wherein said rescue apparatus has been manipulated to conform to a horseshoe rescue device.

8. The rescue apparatus of claim 1 wherein said rescue apparatus has been manipulated to conform to a life ring rescue device.

9. A method for using a H-shaped rescue apparatus that has been manipulated to conform to a rescue device to improve the likelihood of rescuing a man overboard, the method comprising:

removing the H-shaped rescue apparatus from a carrier bag, said H-shaped rescue apparatus having been conformed to a rescue device, such that said rescue apparatus deploys to an H-shaped configuration;

attaching a first free end of a tether line to a fixed object on the rescue vessel;

ensuring that a second end of said tether line remains attached to said rescue apparatus;

throwing said rescue apparatus toward the man overboard;

maneuvering said rescue vessel to allow said tether line to extend to said tether line's full length;

continuing to maneuver said rescue vessel such that said tether line causes said H-shaped configuration of said rescue apparatus to come in contact with said man overboard, and;

completing said maneuvering of said rescue vessel such that one or more elements of said H-shaped configuration of said rescue apparatus on, above or below the surface of the water become entangled with said man overboard.

* * * * *